US008281548B1

(12) United States Patent
Garcia

(10) Patent No.: US 8,281,548 B1
(45) Date of Patent: Oct. 9, 2012

(54) METHOD AND APPARATUS FOR INSTALLING A RIGID PANEL WHILE MAINTAINING A VENTILATION GAP

(76) Inventor: Gene Kevin Garcia, Prospect, KY (US)

( * ) Notice: Subject to any disclaimer, the term of this patent is extended or adjusted under 35 U.S.C. 154(b) by 0 days.

(21) Appl. No.: 13/222,224

(22) Filed: Aug. 31, 2011

(51) Int. Cl.
*E04B 1/00* (2006.01)
*E04G 21/00* (2006.01)
*E04G 23/00* (2006.01)

(52) U.S. Cl. ..... 52/746.11; 52/199; 52/198; 52/95; 52/696; 454/365; 248/302

(58) Field of Classification Search ..... 52/199, 52/198, 94, 95, 90.2, 92.2, 92.3, 696, 285.3, 52/746.11, 749.12, 404.1, 407, 489.1, 489.2, 52/800.1, 800.11, 800.12, 407.4; 454/366, 454/364, 365, 260; 403/384, 397, 387; 248/300, 248/301, 302, 304, 222.11
See application file for complete search history.

(56) References Cited

U.S. PATENT DOCUMENTS

| | | | | |
|---|---|---|---|---|
| 1,535,504 | A | 4/1925 | Stephens | |
| 1,997,580 | A | 4/1935 | Gibson et al. | |
| 1,997,605 | A | 4/1935 | Strom et al. | |
| 2,289,469 | A | 7/1942 | Turner | |
| 2,999,278 | A | 9/1961 | Spencer et al. | |
| 3,365,222 | A * | 1/1968 | Polyak | 403/384 |
| 3,537,221 | A * | 11/1970 | Helfman et al. | 52/289 |
| 4,014,150 | A | 3/1977 | Wells et al. | |
| 4,023,323 | A | 5/1977 | Fortin | |
| 4,126,973 | A * | 11/1978 | Luckey | 52/94 |
| 4,246,736 | A * | 1/1981 | Kovar et al. | 52/696 |
| 4,375,741 | A | 3/1983 | Paliwoda | |
| 4,379,381 | A | 4/1983 | Holcombe | |
| 4,479,339 | A | 10/1984 | Kroh | |
| 4,566,239 | A | 1/1986 | Smigel et al. | |
| 4,642,963 | A | 2/1987 | Borges | |
| 4,724,651 | A | 2/1988 | Fligg | |
| 4,860,502 | A | 8/1989 | Mickelsen | |
| 4,949,929 | A | 8/1990 | Kesselman et al. | |
| 5,058,352 | A | 10/1991 | Loiselle et al. | |
| 5,074,090 | A | 12/1991 | Hafers | |
| 5,239,790 | A | 8/1993 | Fetzer | |
| 5,370,577 | A * | 12/1994 | Jonett et al. | 454/260 |
| 5,535,566 | A | 7/1996 | Wilson et al. | |
| 5,561,959 | A | 10/1996 | Alderman et al. | |
| 5,596,847 | A * | 1/1997 | Stephenson | 52/198 |
| 5,651,224 | A * | 7/1997 | Brabant | 52/288.1 |
| 5,758,464 | A | 6/1998 | Hatton | |
| 6,164,019 | A | 12/2000 | Salley | |
| 6,393,785 | B1 | 5/2002 | Burt | |
| 6,430,881 | B1 * | 8/2002 | Daudet et al. | 52/92.2 |
| 7,017,315 | B2 | 3/2006 | Corwin | |
| 7,654,051 | B2 | 2/2010 | Pollack | |
| 7,788,868 | B2 | 9/2010 | Pollack | |
| 8,137,170 | B2 * | 3/2012 | Klement | 454/365 |

* cited by examiner

*Primary Examiner* — William Gilbert
*Assistant Examiner* — Chi Q Nguyen
(74) *Attorney, Agent, or Firm* — Camoriano and Associates; Theresa Fritz Camoriano

(57) ABSTRACT

A method and a device for installing a rigid panel parallel to a flat building structure and between rafters while providing a ventilation gap between the rigid panel and the flat building structure.

10 Claims, 5 Drawing Sheets

METHOD AND APPARATUS FOR INSTALLING A RIGID PANEL WHILE MAINTAINING A VENTILATION GAP

BACKGROUND

The present invention relates to a method and a device for insulating adjacent to a roof or other flat building structure while maintaining a ventilation gap between the insulation material and the flat building structure to allow for air to flow. This ventilation gap, in conjunction with vents, such as ridge vents, improves airflow as well as insulation efficiency (thermal and sound).

It is known to mount rigid insulation sheets below a roof while maintaining a ventilation gap by using brackets, as disclosed in U.S. Pat. No. 7,017,315 "Corwin". Corwin says in column 4, lines 22-28 that for any of the roof structures shown in FIGS. 1-4 the brackets could be mounted on the rafters first and then the insulating panels 16 installed later, or the brackets could first be secured to the insulating panels and then secured to the rafters. However, it does not appear that all those structures really could be installed in either order as stated.

It appears that the embodiments shown in FIGS. 3-10 would require assembling the panel 16 onto the brackets before installing the brackets onto the rafters, because there would be no way to assemble the insulating panel 16 onto those brackets after the brackets are installed.

The embodiments of FIGS. 1 and 2, which do not have an upper stop above the insulating panel to prevent the insulating panel from moving into the ventilation gap, would permit the brackets to be installed first, before assembling the panel 16 onto the brackets, because, in those embodiments, the insulating panel 16 could be dropped in from the open top before installing the roof. However, since there is no upper stop in those embodiments, if the insulating panel is not later secured to the brackets, only the force of gravity is holding the rigid panel 16 in place to maintain the ventilation gap.

Thus, the various embodiments of Corwin do not provide the convenience of being able to install the brackets onto the rafters first and then installing the rigid panels onto the brackets while also providing a positive upper stop between the insulating panel and the roof or other flat building structure in order to ensure that the desired ventilation gap is maintained.

SUMMARY

The present invention solves that problem. It provides a bracket which may be secured to the rafters before installing the rigid panel, and then allows for simple installation of the rigid panels onto the brackets while also providing a positive upper stop between the rigid panel and the roof or other flat building structure in order to ensure that the desired ventilation gap is maintained.

DESCRIPTION

Figure 1:
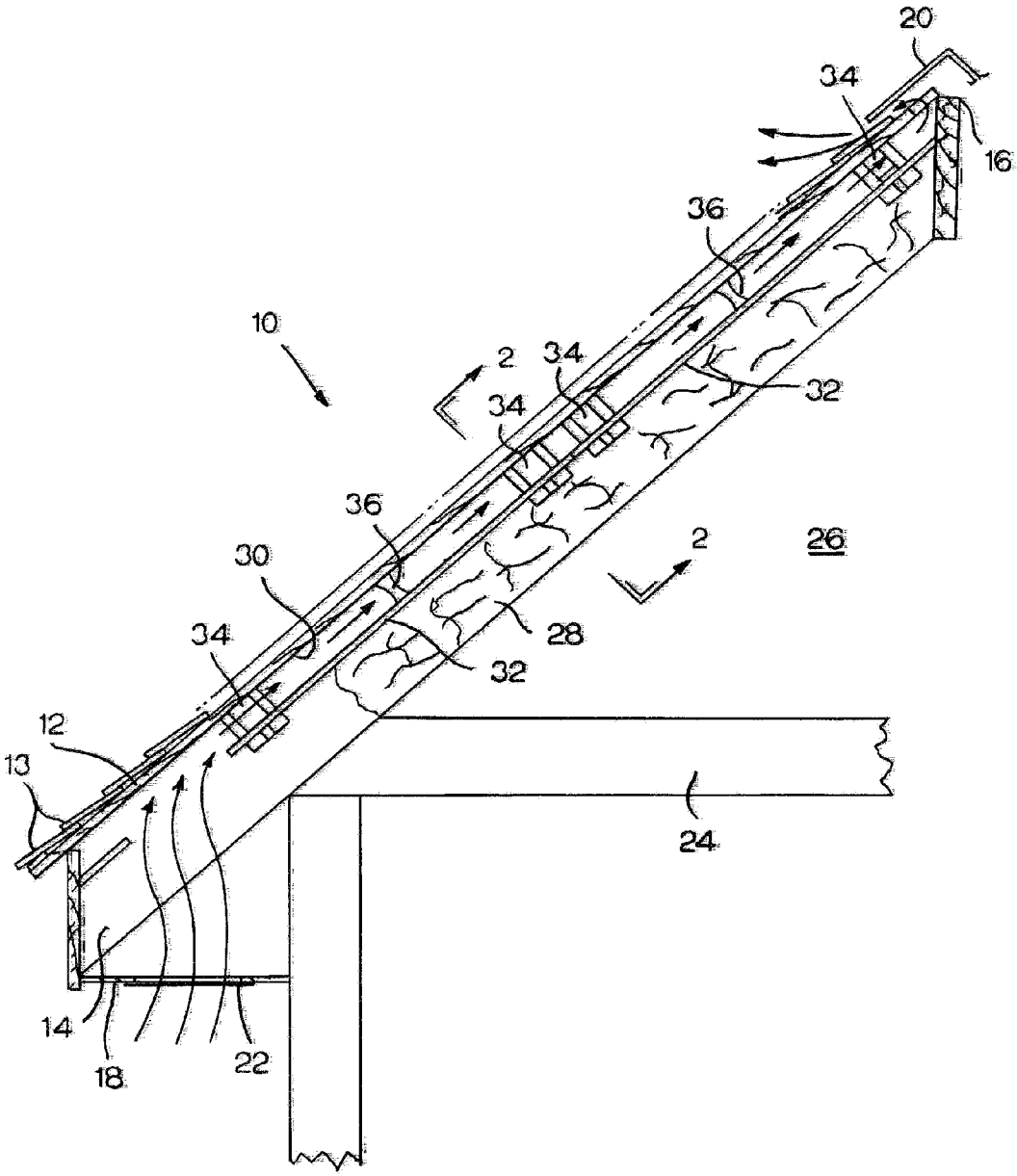
FIG. 1 is a broken-away, section view of a roof structure including brackets mounted to rafters, rigid panels mounted to the brackets, and insulating batts mounted below the rigid panels.
Figure 1A:
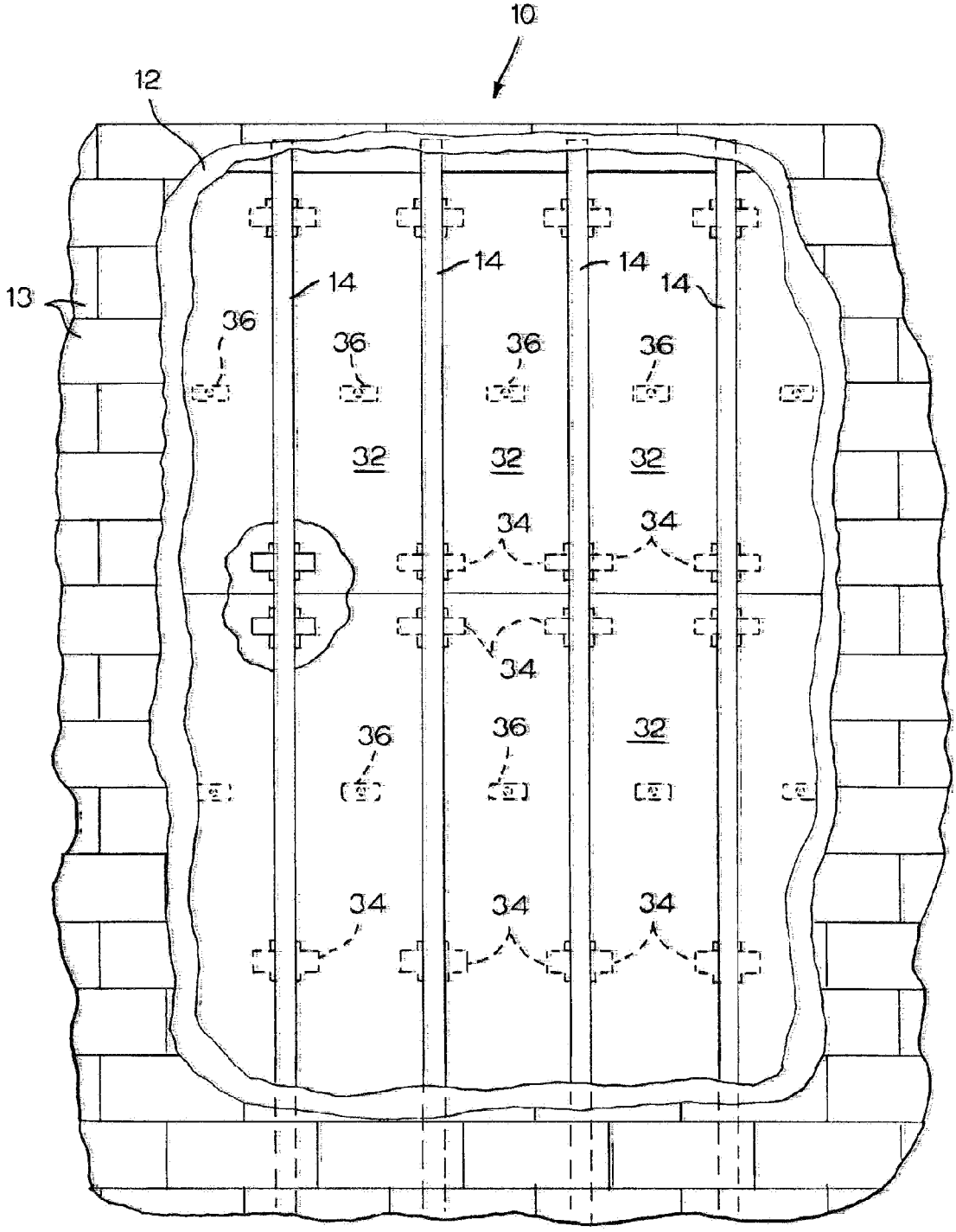
FIG. 1A is a broken away plan view of the structure of FIG. 1, with part of the roof and sheathing removed.
Figure 2:
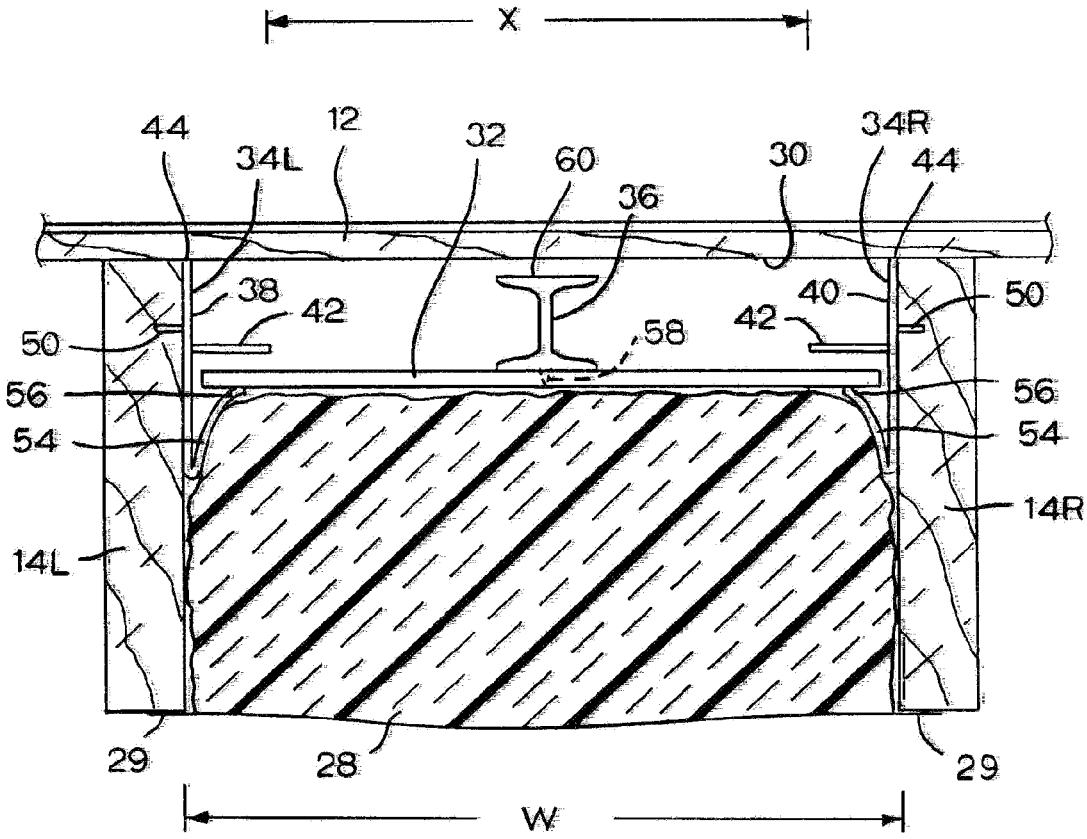
FIG. 2 is a section view along line 2-2 of FIG. 1.

FIGS. 1, 1A and 2 show a roof structure on a building 10. The building 10 includes a roof sheathing 12 (in this case made of plywood) covered with shingles 13, supported on a plurality of parallel wooden rafters 14 which extend from the peak 16 to the eave 18. The peak 16 includes a ridge vent 20, and the eave 18 includes an eave vent 22. Above the ceiling 24 and below the roof sheathing 12 is the attic space 26. Insulation batts 28 are placed between the rafters 14 to insulate between the attic space 26 and the roof sheathing 12. A ventilation gap 30 is provided between the roof sheathing 12 and the insulation 28, which provides a natural circulation of air in the direction of the arrows of FIG. 1, with cooler air being drawn up through the eave vents 22, along the flow path created by the ventilation gap 30, and out through the ridge vent 20 at the peak 16. The ventilation gap and air flow remove moisture and improve the efficiency of the insulation 28. (While a ridge vent 20 is shown here, an alternative arrangement could use a roof vent instead.)

To ensure that the ventilation gap 30 is maintained, rigid panels 32 are mounted between the rafters 14 by means of brackets 34, which maintain the spacing between the rigid panels 32 and the roof sheathing 12. The rigid panels 32 preferably are made of an insulating material, such as polystyrene or polyurethane foam board. (If the rigid panels 32 provide sufficient insulation themselves, or if the goal is just to provide a flow path for venting hot air, the additional layer of insulation 28 may not be needed.) In addition to being supported by the brackets 34, the ventilation gap is maintained by spacers 36 mounted onto the top of the panels 32 midway between the brackets 34 to prevent any unwanted upward bending of the panels 32 into the ventilation gap 30 between the brackets 34. While this embodiment uses just a single spacer 36 in the center of each rigid panel 32, the number and location of the spacers 36 may be arranged as needed to provide sufficient support. In some cases, no spacers would be needed. After the rigid insulating panels 32 are installed, the additional insulation 28 may then be installed below the panels 32, as needed, as shown in FIG. 2. In this embodiment, the insulation batts 28 are made of a fiberglass blanket and include a facing 29 that is stapled to the rafters 14 to secure the insulation batts 28 to the rafters 14.

In FIG. 2, a left bracket 34L is mounted on a left rafter 14L, and a right bracket 34R is mounted on a right rafter 14R directly opposite the left bracket 34L. (The arrangement of the brackets 34 on the rafters 14 in this embodiment can be seen best in FIG. 1A. It is understood that the number and arrangement of brackets 34 may be selected as needed to support the rigid panels 32. For example, if the brackets 34 are wide enough, a single pair of left and right brackets 34L, 34R could be used to support the ends of two adjacent rigid panels 32, thus reducing the number of brackets needed.) The rear of the left bracket 34L abuts the left rafter 14L, and the rear of the right bracket 34R abuts the right rafter 14R. In this embodiment, the left and right brackets 34L and 34R are identical to each other and are described below, generically, as bracket 34.

Figure 3:
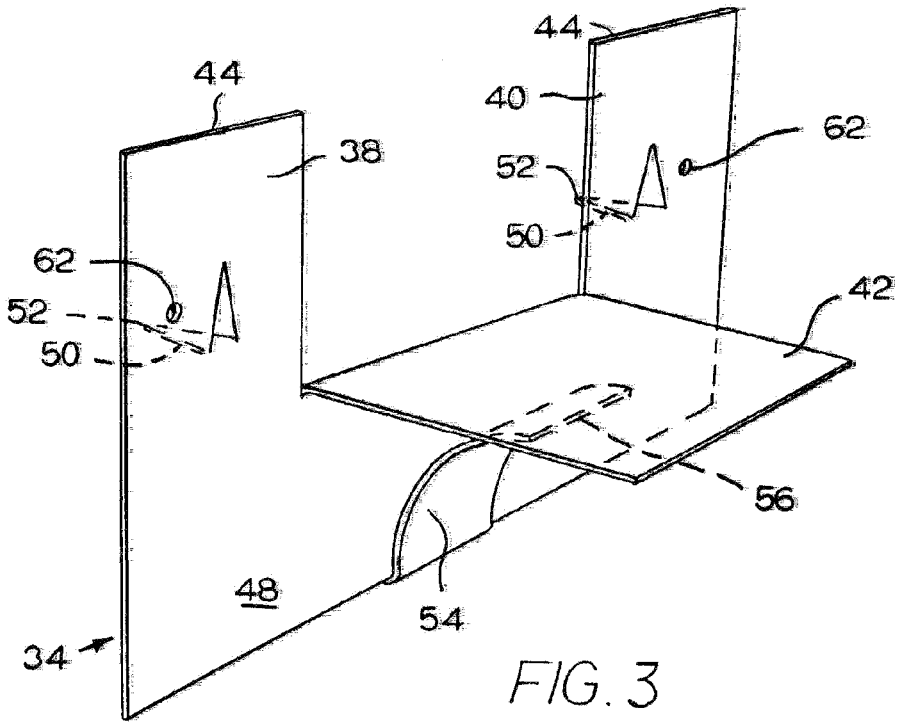
FIG. 3 is a perspective view of the bracket of FIG. 2.
Figure 4:
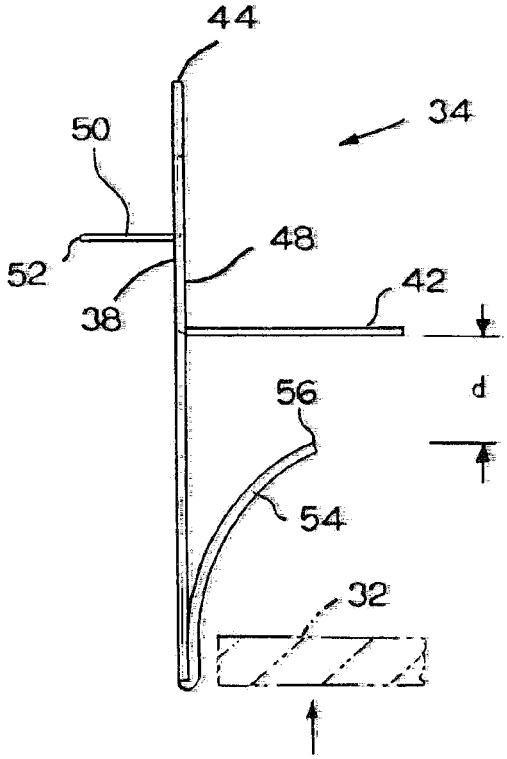
FIG. 4 is a side view of the bracket of FIG. 3.
Figure 4A:
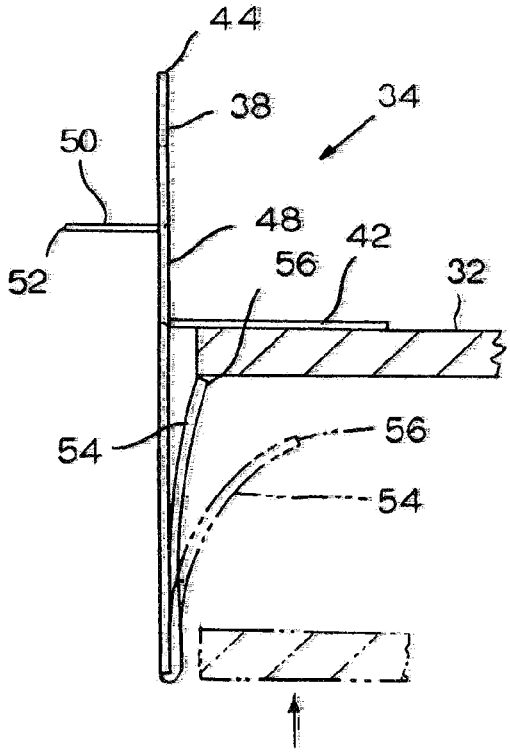
FIG. 4A is a side view, similar to that of FIG. 4, but showing the position of the spring clip as the rigid panel is being installed.

FIGS. 3, 4, and 4A show the bracket 34 in more detail. The bracket 34 includes a flat, vertical plate 48, the rear surface of which mounts against the flat face of the respective rafter 14. A flat, horizontal projection 42 projects forwardly from the vertical plate 48 and serves as an upper stop for the rigid panel 32. Two spacer legs 38, 40 on the vertical plate 48 project upwardly to a higher elevation than the horizontal projection 42 and terminate at free ends 44, which abut the bottom surface of the roof sheathing 12, as shown in FIG. 2. The free ends 44 lie at a first elevation, and the horizontal projection 42 lies at a second elevation, lower than the first elevation. The vertical distance between the first and second elevations defines the ventilation gap 30.

First and second spikes 50 project rearwardly from the vertical plate 48 and are used to mount the brackets 34 onto the rafters 14. In this embodiment, both the upper stop 42 and the spikes 50 are stamped out of the plate 48 and are bent in their respective directions, with the upper stop 42 projecting forwardly and the spikes 50 projecting rearwardly. The spikes 50 have a triangular profile, ending in a sharp point 52, so they may be easily driven into the rafter 14, as by hammering, to secure the bracket 34 to the rafter 14, as shown in FIG. 2. The spacer legs 38, 40 also define small through openings 62 so nails may be driven through the openings 62 to secure the bracket 34 to a rafter 14 in addition to using the spikes 50, if desired.

The bracket 34 further includes a spring clip 54 extending upwardly and forwardly from the bottom edge of the bracket 34 and having a free end 56 that lies at a third elevation, below the elevation of the upper stop 42. In this embodiment, the spring clip 54 lies directly below the upper stop 42 and has an arcuate profile. Once the rigid panel 32 is installed on the brackets 34, the spring clip 54 defines a lower stop for the rigid panel 32, as shown in FIG. 2. In this particular embodiment, the spring clip 54 is stamped and formed from a sheet metal material at the same time as the upper stop 42 and spikes 50 also are being stamped and formed from the same sheet metal material. Alternatively, any of the spring clip 54, spikes 50, and upper stop 42 may be a separate piece that is secured to the plate 48 by means such as crimping, welding, or riveting.

The spring clip 54 is biased toward the extended position shown in FIG. 4 (which is also shown in phantom lines in FIG. 4A). It is movable to a retracted position (shown in solid lines in FIG. 4A) to allow the rigid panel 32 to be pushed upwardly, past the spring clip 54.

As shown in FIG. 2, when the brackets 34 are mounted on the rafters 14, the left bracket 34L defines a rightwardly-extending upper stop 42, and the right bracket 34R defines a leftwardly-extending upper stop 42. The left-to-right distance between the right-most edge of the left upper stop 42 and the left-most edge of the right upper stop 42 is designated X. This left-to-right distance X between the upper stops 42 is less than the left-to-right width W of the rectangular rigid panel 32. The left-to-right distance between the spring clips 54 in the extended position also is less than the left-to-right width W of the rigid panel 32. Since the width W of the rigid panel 32 is greater than the left-to-right space between the upper stops 42 and greater than the left-to-right space between the lower stops 54, once the rigid panel 32 is installed on the brackets 34, the rigid panel 32 is trapped between the upper stops 42 and the lower stops 54.

FIG. 2 also shows an intermediate spacer 36 which includes a short nail or pin 58 which is pressed into the top surface of the rigid panel 32.

Installation:

First, the left and right brackets 34L, 34R are installed on the left and right rafters 14L, 14R, respectively, by aligning the back of the flat plate 48 with the surface of the rafter onto which it is to be installed and abutting the top edges 44 of the spacer legs 38, 40 with the underside of the roof sheathing 12 and then hammering against the front of the plate 48 to drive the spikes 50 into the respective rafter 14. If desired, nails also may be driven through the openings 62 to further secure the brackets to the rafters. In this embodiment, the left and right brackets 34L, 34R are installed directly opposite each other as shown in FIGS. 1A and 2, and at intervals along the rafters, so that each rigid panel 32 is supported by at least two left brackets 34L and two right brackets 34R. In this embodiment, all the brackets 34 are identical to each other.

Once the brackets 34L, 34R are installed on the rafters 14L, 14R, respectively, the intermediate spacers 36 are installed onto the rigid panels 32 by pressing the pin 58 of each spacer 36 downwardly into the top surface of the rigid panel 32.

The rigid panels 32 then are installed onto the brackets 34 by orienting the rigid panel 32 so that it lies parallel to the roof sheathing 12 and pushing each rigid panel 32 upwardly toward the roof sheathing 12, as shown in FIG. 4, until the rigid panel 32 contacts the spring clips 54 of the respective brackets 34. The rigid panel 32 is then pushed further upwardly, causing the spring clips 54 to retract against their spring bias to the position shown in FIG. 4A, until the rigid panel 32 clears the spring clips 54, and the spring clips 54 then spring back to their extended position (shown in phantom in FIG. 4A). The rigid panel 32 is then released, and then is supported on top of the spring clips 54, which also serve as bottom stops. The rigid panel 32 then is trapped between the respective upper stops 42 and lower stops 54 of the left and right brackets 34L, 34R, as shown in FIG. 2. The upper stops 42 (and the intermediate spacers 36) ensure that the ventilation gap 30 is maintained between the roof sheathing 12 and the rigid panel 32.

Once the rigid panel 32 has been mounted between the rafters 14, insulation 28 (such as batts of insulation) may be installed between the rafters 14 below the rigid panel 32, as shown in FIG. 2. Even if the installer pushes the insulation 28 up against the rigid panel 32 enough to displace the rigid panel 32 upwardly, he knows the rigid panel 32 will be stopped by the upper stops 42 (and by the intermediate spacers 36), so the ventilation gap 30 will be preserved.

Figure 5:
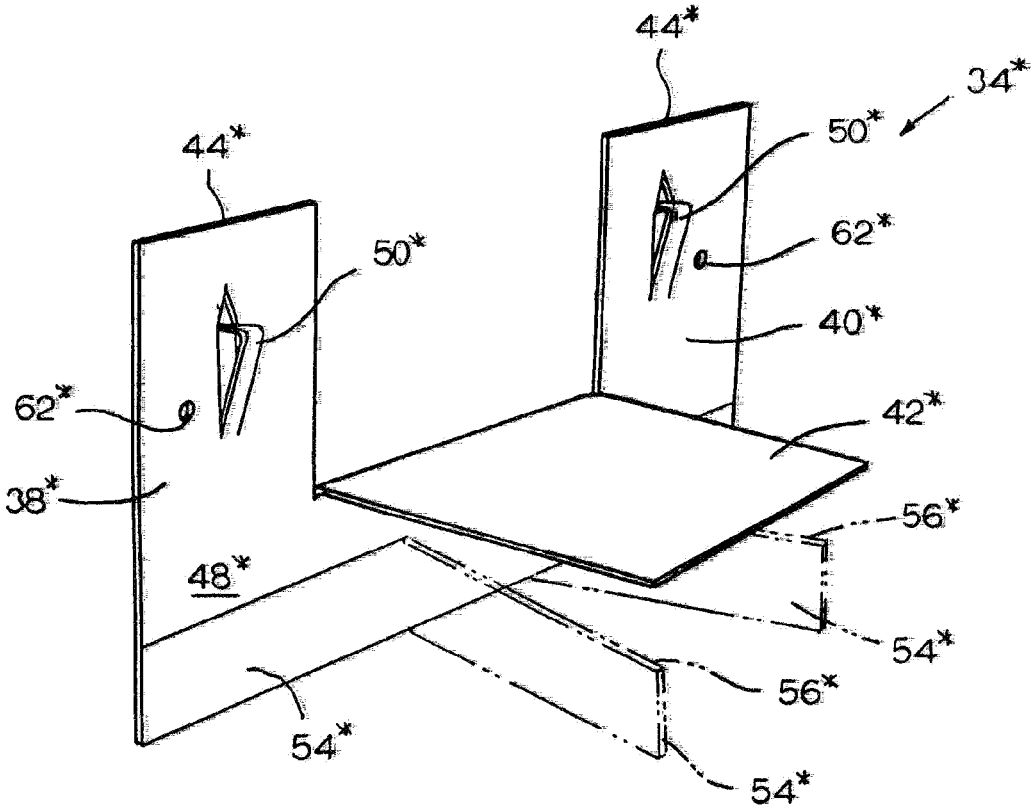
FIG. 5 is a perspective view of an alternative bracket.
Figure 6:
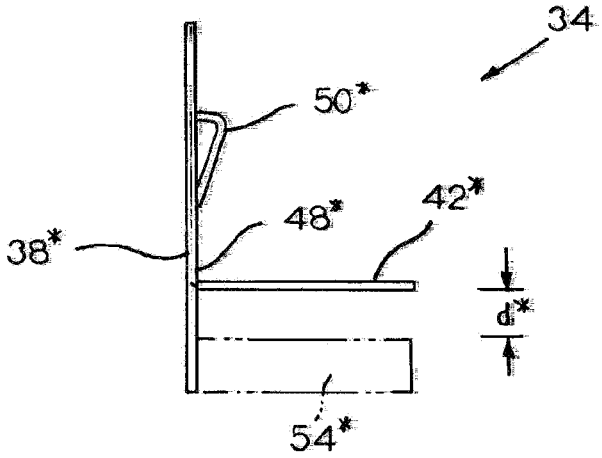
FIG. 6 is a side view of the bracket of FIG. 5.

FIGS. 5 and 6 show an alternative embodiment of a bracket 34* that may be used instead of the bracket 34. This alternative bracket 34* is similar to the first bracket 34 described above in that it includes an upper stop 42*, spacer legs 38*, 40* and bendable tabs 54*, which serve as lower stops. The spacer legs 38*, 40* also define spikes 50* which the user may drive with a hammer to secure the bracket 34* to the rafters 14.

The bendable tabs 54* are initially in a retracted position, coplanar with the flat, vertical plate 48* of the bracket 34*, as shown in solid lines in FIGS. 5 and 6, and they are bent forward to the position shown in phantom in FIG. 5, in order to serve as lower stops for the rigid panel 32.

Installation:

First, the brackets 34* are secured to the rafters 14R, 14L, with the free ends 44* of the spacer legs 38* 40* abutting the bottom surface of the roof sheathing 12, by using a hammer to drive the bent back projections 50* into the rafters 14. Nails may be driven through the openings 62* and into the rafters 14 instead of or in addition to using the projections 50*, as desired. The rigid panel 32 then is pushed upwardly against the upper stop 42* of the brackets 34*. As the rigid panel 32 is held in that position by the installer, he bends one or both of the tabs 54* on each bracket 34* to the extended position shown in phantom in FIGS. 5 and 6, and then releases the rigid panel 32 which will be trapped between the upper stops 42* and the tabs 54*, which serve as lower stops. FIG. 5 shows the tabs 54* bent forward until each tab 54* is substantially perpendicular to the flat plate 48*. However, the tabs 54* may be bent any desired amount by the installer, from a few degrees to the full 90 degrees shown in FIG. 5, or even more, as long as at least one of the tabs 54* on each bracket 34* projects far enough forward that it will support the rigid panel 32.

It may be appreciated that the distance d* (see FIG. 6) between the bottom surface of the upper stop 42* and the top edge of the tab 54* is slightly greater than the thickness of the rigid panel 32, although it could be substantially greater, if desired. In the first embodiment, the distance d between the top of the bottom stop 54 and the bottom of the upper stop 42 is substantially greater than the thickness of the rigid panel 32, as shown in FIG. 4, in order to provide enough room for the lower stop 54 to deform to its retracted position and for the rigid panel 32 to move upwardly beyond the lower stop 54 until the lower stop 54 springs back to its extended position.

With either embodiment of the bracket 34, 34*, the installation of the rigid panel 32 involves moving the lower stops 54 or 54* from a retracted position (which allows the rigid panel 32 to get past the lower stop) to an extended position which will then support the rigid panel 32 once the rigid panel 32 is released by the installer.

This second embodiment also may use the intermediate spacers 36 discussed earlier to provide additional support, preferably at locations midway between the brackets 34*. The rigid panel 32 may be made of an insulating material. As discussed with respect to the first embodiment of the bracket 34, once the rigid panel 32 installation is complete, insulation 28 may be added between the rafters 14 below the rigid panel 32.

While the embodiments described above show brackets 34, 34*, which are intended to be stamped out of sheet metal, it is understood that various other designs, materials, and manufacturing methods could be used. For instance, the brackets may have one or more spacer legs, one or more upper stops, and one or more lower stops. They may be stamped out of metal, injection molded, or made using other known methods.

While these embodiments use the same bracket design throughout a given installation, it would be possible to use different bracket designs within a given installation, and it would be possible for only the lower stops on one side of the rigid panel 32 to be movable between an extended position and a retracted position and for the lower stop on the other side of the rigid panel 32 to be non-movable. In that case, one edge of the rigid panel 32 would first be inserted between the upper and lower stops on the side with the non-movable brackets, and then the opposite edge of the rigid panel 32 would be tilted upwardly to move past the movable lower stops on that side, and then the movable lower stops on that side would be moved to the extended position to hold the rigid panel 32 in place.

Also, while the rigid panels 32 shown here were installed between rafters and with a ventilation gap between the rigid panels 32 and a roof, they could be installed between other parallel boards, which for the purposes of the claims, will also be considered to be rafters, so that pushing the rigid panel 32 upwardly means pushing in the direction from the lower stop toward the upper stop regardless of the orientation of the bracket, and with a ventilation gap between the rigid panels 32 and another flat structure of the building that lies parallel to the rigid panels 32. It will be obvious to those skilled in the art that various other modifications may be made to the embodiments described above without departing from the scope of the present invention as claimed.

What is claimed is:

1. A method for insulating a building having a flat structure supported on rafters, comprising the steps of:

mounting first left and right brackets onto left and right rafters, respectively, each of said first left and right brackets including a pair of spacer legs, having a free end at a first elevation, an upper stop at a second elevation below the first elevation, and a lower stop at a third elevation below the second elevation, with the upper and lower stops of the left bracket projecting to the right and the upper and lower stops of the right bracket projecting to the left; at least one of said first left and right lower stops being movable; said brackets defining a ventilation gap distance extending from the first elevation to the second elevation; and then pushing a flat, rigid panel upwardly, between the first left bracket and the first right bracket, said flat, rigid panel being wider in the left-to-right direction than the left-to-right space between the first left and right upper stops, so that the upward movement of the rigid panel is stopped by the first left and right upper stops, wherein said step of pushing the rigid panel upwardly includes pushing the rigid panel upwardly past the respective movable first left and right lower stops with at least one of the first lower stops in a retracted position; and then moving the at least one movable lower stop to an extended position; and then releasing the rigid panel, whereby the first left and right lower stops limit the downward movement of the rigid panel after it is released, so the rigid panel is trapped between the respective upper and lower stops of the first left and right brackets.

2. A method for insulating a building as recited in claim 1, wherein said at least one movable lower stop is spring-biased, and said step of pushing the rigid panel upwardly causes the lower stop to move against the spring bias to a retracted position, until the rigid panel moves upwardly past the lower stop, and the step of moving the movable lower stop to an extended position includes the spring bias causing the lower stop to spring out to the extended position once the rigid panel has moved upwardly past the lower stop.

3. A method for insulating a building as recited in claim 2, wherein the rigid panel is made of an insulating foam.

4. A method for insulating a building as recited in claim 3, and further comprising the step of installing an insulation batt between the left and right rafters below the rigid panel.

5. A method for insulating a building as recited in claim 4, wherein the bracket includes a sharp projection, and the step of mounting the bracket on the rafter includes hammering the sharp projection of the respective bracket into the respective rafter.

6. A method for insulating a building as recited in claim 1, wherein said movable lower stop is a bendable tab, which lies in a retracted position as the rigid panel is moving upwardly, and wherein the step of moving the movable lower stop to an extended position includes the step of bending the bendable tab to the extended position once the rigid panel has moved upwardly past the lower stop.

7. A method for insulating a building as recited in claim 6, wherein the rigid panel is made of an insulating foam.

8. A method for insulating a building as recited in claim 7, and further comprising the step of installing an insulation batt between the left and right rafters below the rigid panel.

9. A method for insulating a building as recited in claim 8, wherein the bracket includes a sharp projection, and the step of mounting the bracket on the rafter includes hammering the sharp projection on the respective bracket into the respective rafter.

10. A method for insulating a building as recited in claim 1, wherein the bracket includes a sharp projection, and the step of mounting the bracket on the rafter includes hammering the sharp projection from the respective bracket into the respective rafter.

* * * * *